US005544828A

United States Patent [19]

Winkler et al.

[11] Patent Number: 5,544,828

[45] Date of Patent: Aug. 13, 1996

[54] AUTOMATIC BOBBIN-CHANGING DEVICE HAVING A VERTICAL ROTATING AXIS

[75] Inventors: Helmut Winkler, Schwabach; George-Michael Horndler, Barthelmesaurach, both of Germany

[73] Assignee: Maschinenfabrik Niehoff GmbH & Co. KG, Schwabach, Germany

[21] Appl. No.: 232,259

[22] PCT Filed: Nov. 5, 1992

[86] PCT No.: PCT/EP92/02539

§ 371 Date: Jun. 17, 1994

§ 102(e) Date: Jun. 17, 1994

[87] PCT Pub. No.: WO93/09052

PCT Pub. Date: May 13, 1993

[30] Foreign Application Priority Data

Nov. 6, 1991 [DE] Germany ..... 41 36 545.3

[51] Int. Cl.[6] ..... B65H 54/02; B65H 19/22

[52] U.S. Cl. ..... 242/35.50 A; 57/273; 57/281; 242/35.50 R; 242/533.2; 242/533.3; 242/533.7; 414/621; 414/623

[58] Field of Search ..... 242/18 A, 25 A, 242/35.5 R, 35.5 A, 533.2, 533.3, 533.7; 414/621, 623; 57/281, 90, 275, 273, 266

[56] References Cited

U.S. PATENT DOCUMENTS

| | | | |
|---|---|---|---|
| 3,813,866 | 6/1974 | Goldhammer et al. | 57/275 |
| 4,570,430 | 2/1986 | Igel | 57/275 |
| 4,775,271 | 10/1988 | Maccaferri | 242/35.5 A X |
| 4,928,476 | 5/1990 | Otoshima et al. | 57/281 |
| 4,998,407 | 3/1991 | Matsui et al. | 57/281 |
| 5,119,621 | 6/1992 | Inger | 57/281 |

FOREIGN PATENT DOCUMENTS 142813 5/1985 European Pat. Off. .

*Primary Examiner*—William Stryjewski
*Attorney, Agent, or Firm*—Parmelee, Bollinger & Bramblett; George W. Rauchfuss, Jr.

[57] ABSTRACT

An automatic bobbin-changing device (10) for a winding machine with a vertical winding axis, the device having a bobbin carrier (12) which can rotate about a vertical axis (13) and which can adopt two bobbin-holding positions staggered at an angle of about 180°. The bobbin carrier (12) has a total of four gripper arms (25, 26, 27, 28) which work together in pairs to grip a bobbin (1, 2). On each gripper arm (25, 26, 27, 28) is a bobbin-support surface (29) which, during the bobbin-changing operation, is positioned under the bobbin lower-flange (1*b*, 2*b*). The bobbin is changed by lifting the bobbin carrier (12) by means of a lifting mechanism (52, 54, 55) in such a way that the bobbin (1) on the winding machine is lifted off its mounting, the bobbin carrier (12) subsequently being rotated through 180° and lowered again.

14 Claims, 2 Drawing Sheets

AUTOMATIC BOBBIN-CHANGING DEVICE HAVING A VERTICAL ROTATING AXIS

FIELD OF THE INVENTION

The present invention concerns a device for changing the bobbins of a winding machine, which device picks-up a bobbin having a substantially vertical axis.

BACKGROUND OF THE INVENTION

Winding machines of the type under discussion are employed to wind-up or unwind all sorts of rope- or string-shaped products. String- or rope-shaped products are to be understood, above all things, as products or goods such as wire, wire bundles, braids, whereby all of these products can be covered or not covered, glass fibres and the like.

After manufacture, and normally also through the further working and finishing-off process steps, the string-or-rope-shaped products are wound-on and wound-off the bobbins, which bobbins are mostly made of metal. Due to the constant increase in the speed of production of thread or wire products and the constant increase in the finishing-off facilities, the filling times and emptying times of these bobbins is always becoming shorter, as is also the case with larger bobbins. Therefore, it is necessary for the rational operation of such a facility that the filled and empty bobbins are exchanged relatively quickly for an empty bobbin and a filled bobbin, respectively.

A movable automatic bobbin-changing device has become known in German Patent P 3137990 C2, which device can be used, among other possibilities for changing bobbins of winders having a vertical winding axis. This known bobbin-changing device has a supporting arm movably supported in the center of the device and on whose respective opposing ends a bobbin can be coupled thereto. The supporting arm is further provided with devices in order to rotate the bobbins connected on its ends. In order to carry out a bobbin change with a winder which, for example, winds up thread, the bobbin-changing device travels to the winder whereby on one side of the supporting arm an empty bobbin is provided which rotates with the same speed of rotation as the wind-up bobbin located in the winder. The bobbin-changing device is brought into position at the winder and is connected with the most filled bobbin in the winder such that driving of this bobbin is now carried out by way of the bobbin-changing device. The supporting arm is then rotated around 180° whereby at the same time, the thread is cut and glued to the filled bobbin. As soon as the empty bobbin has taken the position of the full bobbin in the winder, the thread to be run in the winder is attached to the bobbin and the wind-up process continues.

Although this bobbin-changing device works very satisfactorily, there arises problems due to the constant increase in the speed of production. Upon release of a bobbin-change demand signal by a winder, the bobbin-changing device of the known type requires a certain time in order that the device can be brought in the appropriate position. Furthermore, a considerable time is required until the bobbin-changing device has moved the full bobbin to a corresponding magazine or storehouse and a new empty bobbin is picked-up in order that a further bobbin-change can be carried out. Therefore, the application of such a movable bobbin-changing device qualifies as being problematic when the times for filling the bobbins are reduced and as a result, the number of bobbin-changes to be carried out increases.

SUMMARY OF THE INVENTION

A device for gripping and holding a sleeve is known from DE-A-3305991. The sleeve is in particular a cylindrical sleeve, on which yarn is wound up in such a way that the yarn has conical end portions. The holding of the sleeve is made by two gripping elements, being arranged opposite to each other, which have a cylindrical portion for clamping the sleeve and a portion, which opens conically, supporting the conical end portions of the yarn, for receiving tilting forces. The device is provided to plug and un-plug such sleeves in a textile apparatus. It is not disclosed in this document to use such a device outside the textile machine branch.

Thus, the task of the present invention is to provide a bobbin-changing device which, despite its simple construction, reliably and quickly carries out a bobbin-change on a winding machine having a vertical winding axis.

The bobbin-changing device according to the invention comprises a bobbin carrier which can rotate around a vertical axis and which has four rotatable gripper arms. As well, the (inner) ends of the gripper can rotate around axes which lie close to the vertical axis. A driving device is provided so that the gripper arms can swing around their respective rotating axis whereby, at least the movement of a pair of respective gripper arms is coupled to each other. On the other (outer) end of each of the gripper arms at least one bobbin-support surface is provided. The bobbin carrier having the four gripper arms can, by means of a lifting mechanism, be raised substantially in the vertical direction. The dimensions and swing angles of the gripper arms, as well as the bobbin-support surfaces are so dimensioned that the gripper arms can grip a bobbin having a vertical axis and the lower flange of the bobbin lies on top of the bobbin-support surfaces.

This configuration allows a particularly quick and functionally safe bobbin-change as will be described in the following. For simplicity, the bobbin located in the winding machine is identified as the full bobbin, and the other bobbin which is to be exchanged against this bobbin is identified as the empty bobbin.

The empty bobbin is brought by a handling device or a conveying device, to a position where the bobbin can be gripped by two of the gripper arms which are associated with each other in movement. As soon as the bobbin located in the winding machine is full, this bobbin is also gripped by two of the gripper arms. It is hereby pointed out that the gripping of both bobbins can be carried out simultaneously or one after the other.

When both of the bobbins are gripped, the lifting mechanism is operated whereby the bobbin-supporting surfaces come in contact with the lower flanges of the bobbins. The bobbins are raised and the full bobbin located in the winding machine is taken from the driving cone or its mounting. In the case that the winding machine additionally comprises an upper spindle sleeve in order to reach in the central bore of the winding body from above, the spindle sleeve is beforehand removed from the bore of the winder. Finally, a rotating device is actuated and the bobbin carrier swings around an angle of 180° whereby empty bobbins and full bobbins exchange their positions. The lifting mechanism is lowered so that the empty bobbin rests on the driving cone of the winding machine, and in the case where the spindle sleeve is present, the sleeve is inserted in the central bore. Finally, the gripper arms are moved away from the bobbins. Then, the winding up and the unwinding of the rope-shaped goods or products can be carried out on or from the bobbin newly placed in the winding machine.

In order to also use the bobbin-changing device in process being continually worked, the device is preferrably combined with a temporary storage device on which a set amount of rope- or string-shaped products can be temporarily stored over a short time.

Trials have shown that with the bobbin-changing device according to the invention, bobbin-changing times can be realized which lie significantly under one minute. This short time for changing a bobbin has significant advantages for practical operation purposes. In the case that during the changing of a bobbin, the respective production process is interrupted, this interruption only lasts a very short time and as such does not significantly affect the operational process. Against this problem, should a temporary storage device be used in order not to interrupt the production process, this storage device can be dimensioned appropriately small and is therefore low in cost.

The bobbin-changing device has furthermore the advantage that this device is easier to construct as opposed to the known bobbin-changing devices of the prior art, such that, the device of the present invention can be manufactured at lower costs. Accordingly, it is also possible with larger facilities to provide every winding machine with its own corresponding bobbin-changing device.

A further significant advantage of this bobbin-changing device over the other known bobbin-changing devices is to be seen from the fact that for the operation of the bobbin-changing device, no special devices must be provided with the winding machine. For the bobbin-changing device to function, it is sufficient that an opening is present under the lower flange of the bobbin in which the bobbin-support surfaces can be inserted. Special devices for raising the bobbins, for releasing or moving the bobbins out from the machine must not be fixed to the winding machine.

A further advantage is that the gripper arms can be so formed that they have a large swing area. Accordingly, the gripper arms can be kept far removed from the bobbins such that the transporting of the bobbins to and from the bobbin-changing position can be carried out without any problems.

BRIEF DESCRIPTION OF THE DRAWINGS

Further advantages, features and possibilities for application of the present invention are presented in the following description of an embodiment of the invention, together with the drawings.

DETAILED DESCRIPTION OF THE INVENTION

Figure 1:
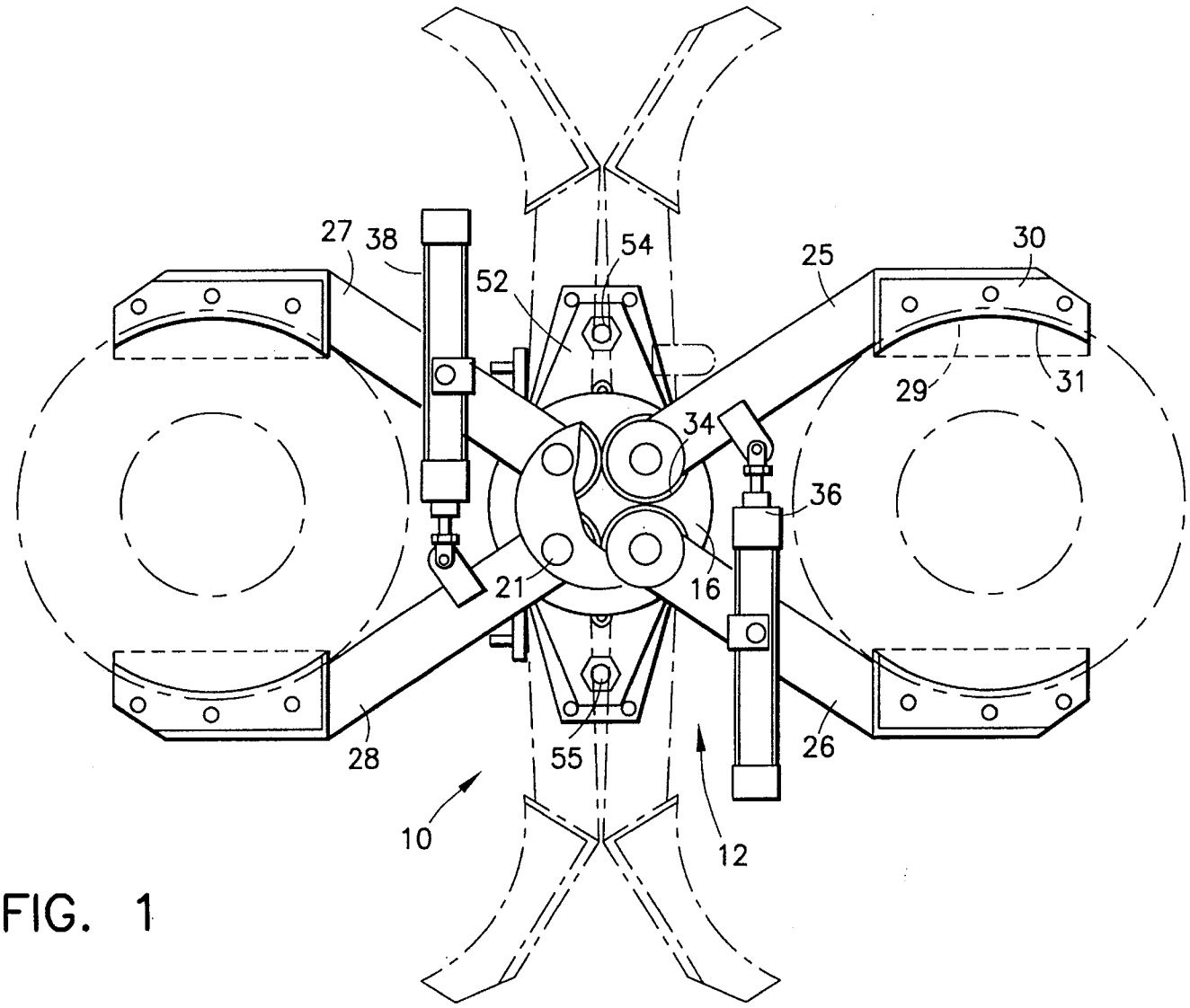
FIG. 1: shows a schematic top view of an embodiment of the bobbin-changing device according to the invention.

The described embodiment is used in connection with a winding machine on which the thread is wound and in which, the bobbin occupies a vertical position during the winding operation. With the representation according to FIG. 2, it is assumed that the bobbin 1 is a full bobbin to be exchanged for the empty bobbin 2. Each one of the bobbins comprises an upper flange 1*a*, 2*a* and a lower flange 1*b*, 2*b*. Both flanges are joined with a winding core 1*c*, 2*c* whereby in this embodiment a cylindrical winding core is represented. Instead of the cylindrical winding core, a conical winding core can also be employed whereby the smaller diameter of the conical winding core is then preferrably located at the lower end, that is, at the lower flanges 1*b*, 2*b*.

The bobbin-changing device, indicated in total by reference number 10, comprises a bobbin carrier 12 which is swingable about a (fictitious) substantially vertical axis 13. The region of swing of this embodiment is calculated such that the bobbin carrier can rotate at an angle of approximately 185° around this axis 13. An upper plate 16, which according to this embodiment is round, and likewise, a round lower plate 18 are arranged concentric to the axis 13 and at a distance to each other. In the plate 16, four pivotable bolts 21 are fixed which can be particularly seen in the section drawing according to FIG. 2. On each of the four pivotable bolts 21 a bush bearing 23 having an appropriate bore is supported whereby the bearing is preferrably carried out with roller bearings, not shown in FIGS. 1 and 2. On these bush bearings 23, four gripper arms 25, 26, 27 and 28 are fixed. At the end of each of the gripper arms, opposite to the bush bearing, a plate-shaped support surface 29 is provided which can be seen, particularly from the representation according to FIG. 1 (shown by the broken line). The support surface 29 is connected with jaws 30 which have a recess 31 in the shape of a circular segment for receiving the flanges of the bobbins.

With the embodiment as shown, in order to hold the bobbins 1 and 2, two respective gripper arms work together, namely, the gripper arms 25 and 26, as well as gripper arms 27 and 28. This working-together is caused by pinion 34 each of which is arranged concentric to the pivotable bolts 21 and the bush bearings 23 adjacent to the lower plate, and the diameter of the gears are so dimensioned that the gears 34 corresponding to the pair of gripper arms which work together, engage with each other. Due to the fact that the interacting gripper arms are coupled kinematically with each other, a respective pneumatic or hydraulic driven piston-cylinder-device 36 and 38 suffices in order to move the gripper arms towards each other and away from each other. As such, the piston stroke of the piston-cylinder-device 36 and 38 can be so dimensioned that the gripper arms can open so wide that practically an angle of around 180° can be formed between the respective pairs of interacting gripper arms 25, 26 and 27, 28. This widest opening position of the gripper arms is shown by the broken line in FIG. 1.

At this point, it is to be noted that it is also possible for the pivotable bolts 21 and the gears 34 to be so arranged and dimensioned that all four gears 34 engage with each other and, consequently, all four gripper arms are kinematically coupled with one another. This has the advantage that in total only one piston-cylinder-unit is necessary in order to actuate the gripper arms. However, the disadvantage speaking against this arrangement is that the bobbin-changing device can only change bobbins which have the same diameter.

In case the situation arises, for example, in order to satisfy the demands of different consumers, where a bobbin 1 having a large diameter is to be exchanged for a bobbin 2 having a smaller diameter, then the version having two piston-cylinder-units 36, 38 and only two gripper arms which are coupled to have a related movement to each other, should be preferred.

Figure 2:
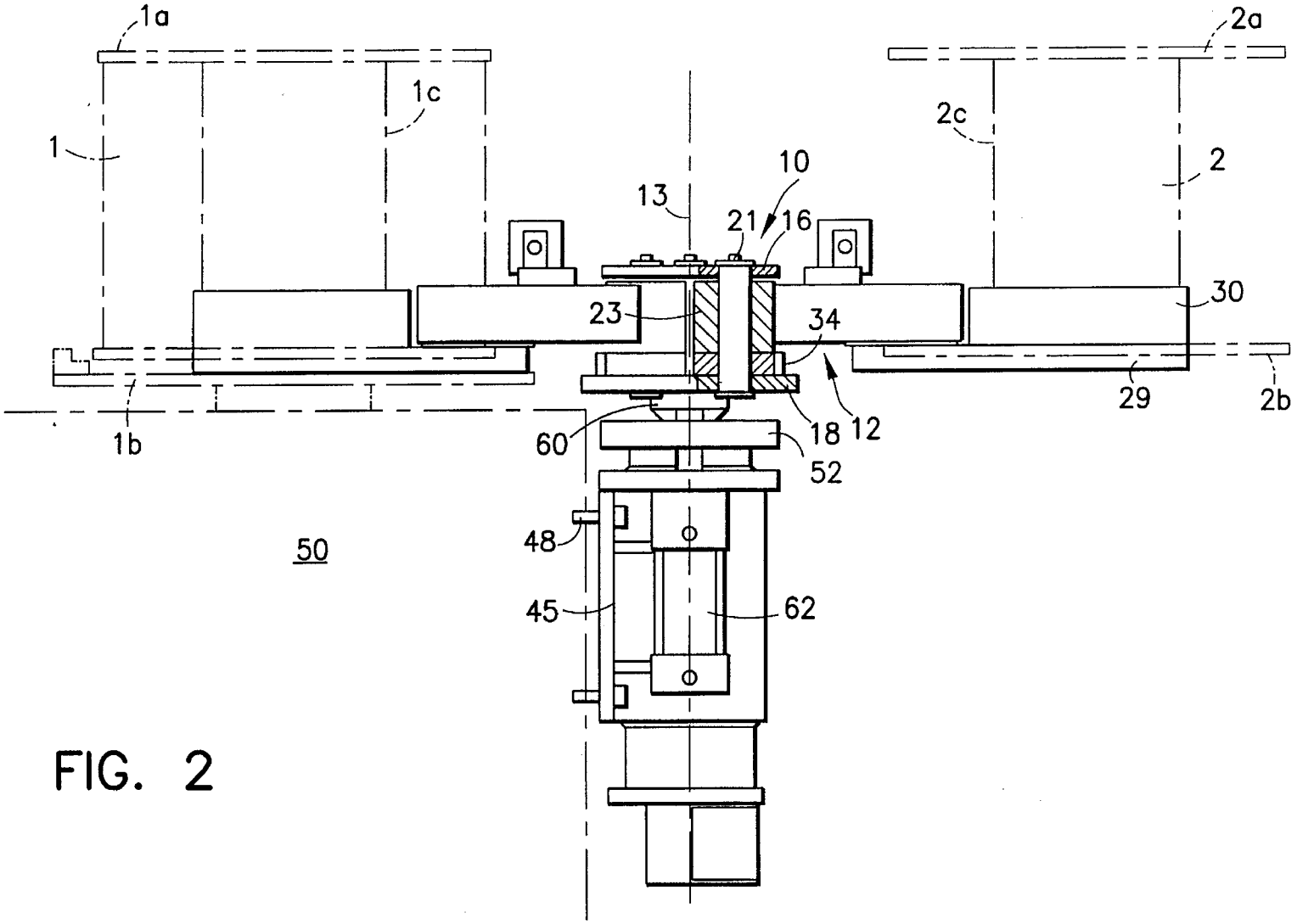
FIG. 2: shows a schematic side view of the embodiment according to FIG. 1.

The bobbin carrier is received by a body 45 which, as can be seen from FIG. 2, is preferrably fixed directly to the foundation 50 by means of a fixing device 48 or fixed to the corresponding frame of the winding machine. A plate 52 is arranged at a distance from the body 45, which plate can be raised and lowered by means of piston-cylinder-devices 54, 55, whose pistons are seen in the view according to FIG. 1. The piston-cylinder-devices are hydraulically or pneumatically operated.

A carrier body 60 is held rotatable in the plate 52 whereby this axis of rotation forms the axis of swing 13 of the bobbin-changing device. The bearing of the carrier body 60 is carried out in a known way by roller bearings or the like and, therefore, is not represented in the Figures.

In this embodiment, the rotational movement of the bobbin carrier is caused by a rotating cylinder 62. The rotating cylinder 62 which is operated hydraulically or pneumatically, comprises a stationary part which is firmly connected with the body 45 and comprises a rotatable part which is connected with the carrier body 60. The rotating cylinder 62 includes an internal lifting piston, whereby this lifting piston is connected with a threaded spindle in such a way that the lifting movement of the piston is converted to a rotation of the moving part with respect to the fixed part. Since pressure fluid is needed to operate the piston-cylinder-devices 36, 38, the use of such a rotating cylinder in order to affect rotational movement of the bobbin carrier is of a particularly simple constructional and cost effective possibility.

However, instead of such a rotating cylinder, other suitable devices can also be used. In particular, it is possible to arrange on the bobbin carrier concentric to the axis 13, a rotating ring having teeth which is rotated via a pinion and a gear motor.

The bobbin-changing device comprises a control device not shown in the Figures. This control device is connected with one or more sensors which, for example, detect if the bobbin 1 is full, if the bobbin 2 is located in the correct position and the like. The control device can output control commands which cause the piston-cylinder-devices 36, 38, 54, 55 and the rotating cylinder 62 to operate. The control device can also be integrated in a primary control device which serves to control greater parts of the production process.

The function of this device is as follows:

While the spool 1 is being wound, the spool 2 is brought either by a handling device or by a conveying device (not shown) in a position that allows the spool to be gripped by the gripper arms 25, 26. Due to the wide opening angle of the pair of gripper arms the positioning of the spool is not hindered in any way.

In the embodiment according to FIGS. 1 and 2, as soon as the bobbin 2 is positioned, the piston-cylinder-device 36 can be operated in order to move the (opened) gripper arms 25, 26 towards one and other. This closing movement of the gripper arms is allowed to continue until the supporting surfaces 29 grip under the lower flange 2*b* of the bobbin and the jaws 30 sit closely to the flange of the bobbin. It is pointed out here that the bobbin 2 is to be so positioned that it is possible for the supporting surface 29 to grip under the flange of the bobbin.

As soon as bobbin 1 is fully wound, the rope- or cord-like product which has been wound in the winding machine is cut and its end is glued onto the bobbin 1. This cutting and glueing can be carried out during the bobbin-changing procedure.

When the control device receives the signal that the bobbin 1 is full, a signal is output which orders the piston-cylinder-device 38 to operate. The gripper arms 27 and 28 are moved towards each other until likewise the support surfaces 29 grip under the lower flange 1*b* and the flange rests next to the jaws 30.

The closing of the gripper arms can, as mentioned, also be carried out simultaneously.

Once both spools have been gripped, the piston-cylinder-devices 54, 55 are operated and the bobbin carrier is raised. By this action, the bobbin 1 is detached from its mounting and respectively, the take-up cone. As soon as the bobbin 1 is free, which, when need be, can be detected and tested by an appropriate sensor, the rotating cylinder 62 is actuated and the bobbin carrier swings around an angle of 180°. The finding of the correct position can be guaranteed by stoppers or by appropriate sensors. The bobbin 1 and bobbin 2 have now exchanged their positions as represented in FIGS. 1 and 2. Thereafter, the piston-cylinder-devices 54, 55 is again actuated and the bobbin carrier is lowered and as a result the empty bobbin is taken-up by the mounting or take-up cone of the winding machine. Finally, the free end of the thread is connected in a suitable way with the empty bobbin and the winding-up process is continued.

In order not to interrupt the production process, a storage device is preferrably added to the winding machine in which the string- or rope-shaped product is stored temporarily while a bobbin-change is being carried out. This arrangement has the advantage that a continual production process is not interrupted by changing of the bobbin.

In connection with the bobbin-changing device according to the invention, a winding machine is preferrably used which rotates the bobbin during the winding-up and unwinding process steps. According to another preferred embodiment, the bobbin-changing device can also be used with a winding machine with which the bobbin stands still during the winding process and the winding-up of the product to be wound is carried out by means of a traversing unit which rotates around the bobbin. Furthermore, it is also possible to use the bobbin-changing device according to the invention in connection with a delivering device with which the delivery or discharge of the product is carried out via a head or an unwinding flyer spinning machine means.

We claim:

1. Automatic bobbin-changing device comprising:

a bobbin carrier which is rotatable about a first vertical axis from a first to a second bobbin-holding position displaced at an angle of about 180°, and vice versa;

said bobbin carrier comprising four gripper arms each having a first inner end rotatably supported about a rotating axis near to said first vertical axis and a second outer end, whereby the rotating axis of each gripper arm is parallel to said first vertical axis and at least one bobbin-support surface is provided on each second outer end of each of said gripper arms;

said four gripper arms being arranged in a first pair and in a second pair, each gripper arm of each pair being coupled in relative movement to said other gripper arm of said pair;

a first driving device which causes a rotating movement of the gripper arms about the rotating axes;

a lifting mechanism provided to raise the whole bobbin carrier along the direction of said first vertical axis; and a second driving device which causes a rotating movement of said raised bobbin carrier about said first vertical axis, from said first bobbin-holding position into said second bobbin-holding position;

said gripper arms and said first driving device being dimensioned such that each said pair of gripper arms is moveable with respect to a bobbin in such a way that the bobbin-support surface is positioned underneath a flange of the bobbin.

2. Device according to claim 1, characterized in that all four gripper arms are coupled with each other in related movement.

3. Device according to claim 2, characterized in that the related movement coupling of the gripper arms is effected by four gears each arranged concentric to the rotating axes of the gripper arms and connected thereto against rotation whereby the gears of the gripper arms adjacent to one another are respectively engaged with one another.

4. Device according to claim 3, characterized in that a double operating piston-cylinder-device is provided which is connected with two gripper arms in order to cause a swing movement of all four gripper arms.

5. Device according to claim 4, characterized in that the bobbin-support surfaces are each connected with a jaw which rests next to an outer diameter of the flange of the bobbin when the supporting surface is positioned under the bobbin flange.

6. Device according to claim 1, characterized in that the bobbin-support surfaces are each connected with a jaw which rests next to an outer diameter of the flange of the bobbin when the supporting surface is positioned under the bobbin flange.

7. Device according to claim 6, characterized in that the rotation of the bobbin carrier around said vertical axis is caused by a rotating cylinder.

8. Device according to claim 7, characterized in that an angle of swing of the gripper arms is dimensioned in such a way that an opening angle between two gripper arms associated with each other in related movement, amounts to approximately 180°.

9. Device according to claim 6, characterized in that the lifting movement is caused by two piston-cylinder-devices which are arranged symmetric to said vertical axis.

10. Device according to claim 1, characterized in that the lifting movement is caused by two piston-cylinder-devices which are arranged symmetric to said vertical axis.

11. Device according to claim 10, characterized in that the rotation of the bobbin carrier around said vertical axis is caused by a rotating cylinder.

12. Device according to claim 1, characterized in that an angle of swing of the gripper arms is dimensioned in such a way that an opening angle between two gripper arms associated with each other in related movement, amounts to approximately 180°.

13. Device according to claim 1, characterized in that each gripper arm is connected against rotation with a pinion, each pinion of one such gripper arm is arranged in such a way that each said pinion engages with a corresponding pinion of a gripper arm associated in relative movement with said one such gripper arm.

14. Device according to claim 13, characterized in that said pair of gripper arms associated with each other in related movement, are connected to one another with a double operating piston-cylinder-device in such a way that the pair of gripper arms are moveable towards each other and away from each other by operation of the piston-cylinder-device.

* * * * *